US005385090A

United States Patent [19]

Coret et al.

[11] Patent Number: 5,385,090

[45] Date of Patent: Jan. 31, 1995

[54] DEVICE FOR LOCKING THE PRINTWHEELS OF A POSTAGE METER

[75] Inventors: Francis Coret, Neuilly Plaisance; Michel Gravillon, Sucy en Brie, both of France

[73] Assignee: Neopost Industrie, Bagneux, France

[21] Appl. No.: 171,666

[22] Filed: Dec. 22, 1993

[30] Foreign Application Priority Data

Dec. 22, 1992 [FR] France ..... 92 15497

[51] Int. Cl.[6] ..... B41J 1/60

[52] U.S. Cl. ..... 101/110; 101/91; 101/99

[58] Field of Search ..... 101/45, 91, 92, 93, 101/93.2, 93.21, 99, 106, 110; 235/101

[56] References Cited

U.S. PATENT DOCUMENTS

| | | | |
|---|---|---|---|
| 4,127,064 | 11/1978 | Pettis, Jr. | 101/110 X |
| 4,160,899 | 7/1979 | Montagnino et al. | 235/101 |
| 4,220,082 | 9/1980 | Edwards | 101/110 X |
| 4,345,521 | 8/1982 | Soderberg et al. | 101/93 |
| 4,398,458 | 8/1983 | Denzin | 101/91 |
| 4,398,461 | 8/1983 | Koike | 101/99 |
| 4,421,023 | 12/1983 | Kittredge | 101/45 |
| 4,601,240 | 7/1986 | Sette | 101/99 X |
| 4,702,164 | 10/1987 | Muller | 101/91 |
| 4,723,486 | 2/1988 | Le Meur et al. | 101/91 |
| 4,936,209 | 6/1990 | Diel | 101/93.01 |

OTHER PUBLICATIONS

IBM Technical Disclosure Bulletin, vol. 4, No. 1, Jun. 1961 "Magnetic Print Wheel Clutch".

*Primary Examiner*—Edgar S. Burr
*Assistant Examiner*—Christopher A. Bennett
*Attorney, Agent, or Firm*—Sughrue, Mion, Zinn, Macpeak & Seas

[57] ABSTRACT

A device for positively locking the printwheels (2) fitted to the print drum (1) of a postage meter. A tilting bail (5) locks the printwheels (2) against the force of a return spring (8). A sliding pull rod (26) provided with a yoke (30) that co-operates with a fixed collar (31) disposed coaxially with the rotary drum (1) ensures that locking is secure by preventing an arm (11) of the bail (5) from moving whenever the drum (1) is rotating.

2 Claims, 1 Drawing Sheet

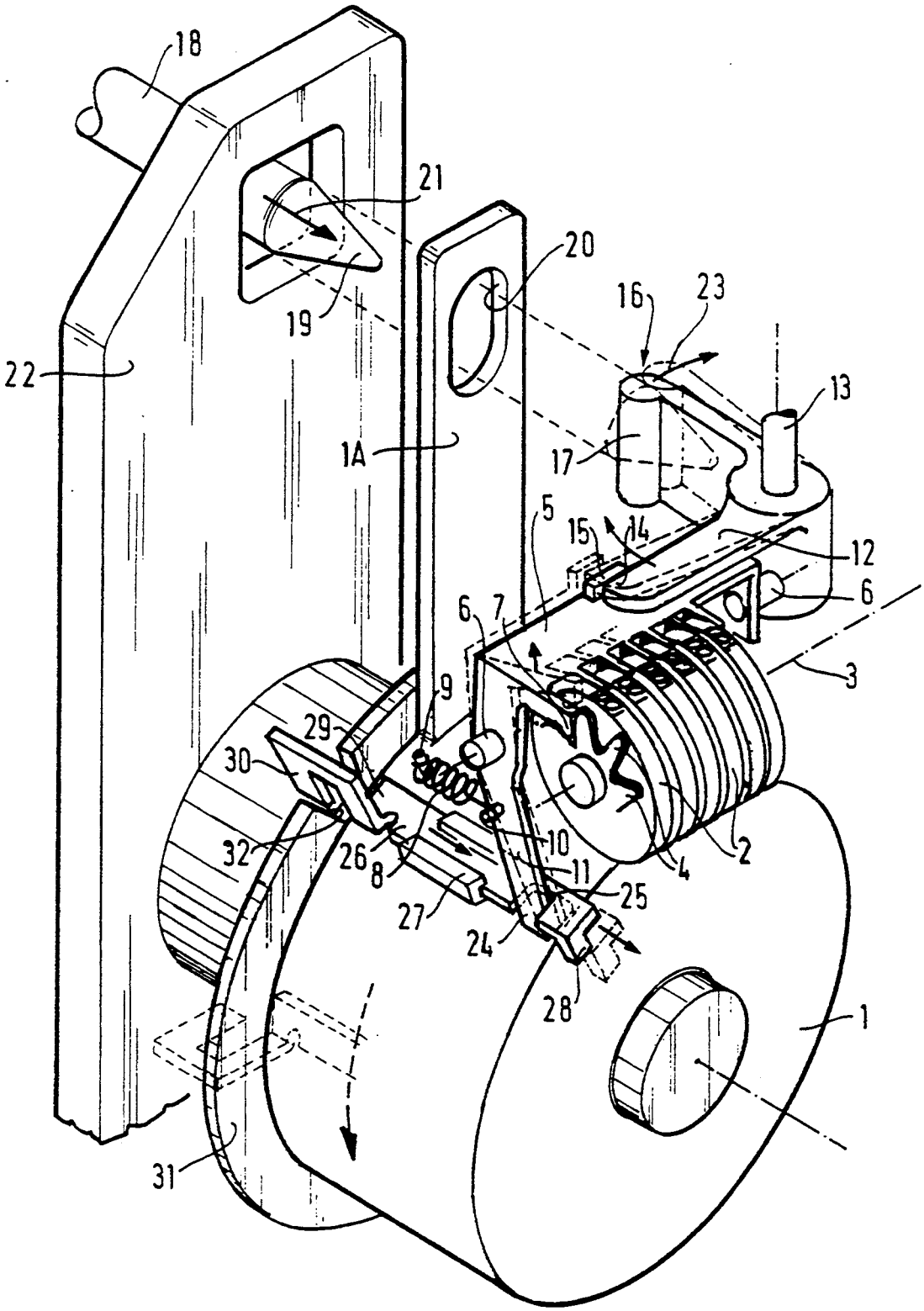
18
21
20
16
23
19
22
13
1A
17
5
15
14
12
6
6
7
3
9
29
30
32
26
8
10
11
25
27
24
28
4
2
1
31

DEVICE FOR LOCKING THE PRINTWHEELS OF A POSTAGE METER

BACKGROUND OF THE INVENTION

The present invention relates to postage meters (or "franking machines") in which the print head comprises a print drum carrying printwheels. More particularly, in such machines the invention relates to a device for locking the printwheels in position.

In conventional manner, printwheels are rotatably mounted on the drum so as to enable their positions to be adjusted, while they are not franking mail. In addition, they project slightly from the periphery of the drum and they are rotatable therewith for the purpose of printing both fixed and variable franking information for each revolution of the drum. The printwheels are used for printing variable information such as postage date and amount. The print drum thus carries two sets of printwheels for variable information, which wheels project from the drum through appropriate openings in a printing plate engraved with a postal flier. This engraved plate fits around the periphery of the drum and carries fixed postal information in the form of a print for the postage stamp proper and a print for the home post office, or for some other specified information. In general, the same drum also carries another engraved plate for advertising purposes which is analogous to the first but is often removably mounted, and which serves for printing unchanging advertising information. In some machines, other print means such as one or more removable blocks are associated with the drum.

For position adjustment purposes, the printwheels are generally coupled to a motor or to a manually driven control assembly having gear wheels referred to as driving gear wheels which, by means of respective drive systems serve to drive driven gear wheels on the printwheels. The motor-driven control assembly is then connected to a control card itself connected to data input means, e.g. a keypad and associated display screen on the machine.

Once adjustment has been performed, an object of the invention is to lock the racks and the printwheels on each printing cycle while they are rotating with the drum.

It is absolutely essential, and indeed legally required, to provide a device that hinders any attempt at changing the settings of the printwheels while the print drum is rotating.

Such locking devices already exist, and, by way of example of the prior art on this topic, mention may be made of French patent application FR-A-2 665 781, filed by the Applicant company on Aug. 7, 1990.

SUMMARY OF THE INVENTION

Compared with prior art devices, the present invention proposes providing a device which uses a solution that is simple, providing highly positive locking, and that is advantageously suitable for being disengaged by a member such as a centering finger, that serves to perform some other function in the postage meter.

To this end, the present invention provides a device for locking adjustable printwheels which are carried in alignment on a common axis by a rotary print drum fitted to a postage meter, each of said adjustable printwheels being secured to a respective coaxial toothed wheel, the device comprising:

firstly a bail mounted on the drum to be tiltable about a shaft parallel to the axis of the printwheels the bail including at least as many locking teeth as there are printwheels, which teeth are designed to engage in at least one of the teeth of each of said respective toothed wheel when said bail is urged towards its printwheel-locking position by at least one return spring fixed on the print drum, said bail being tilted against the force of the return spring into a position in which it unlocks the printwheels under the control of a crank lever mounted to rock about an axis orthogonal to the tilt axis of the bail, the crank lever having a first free end that bears against an abutment secured to the bail and having another free end designed to be pushed back, thus rocking said lever, by means of an unlocking control member such as an unlocking finger which is external to the drum; and secondly a locking security pull rod slidably mounted on a generator line of the drum and including a notch or opening in which an arm of the bail is permanently engaged such that tilting of the bail and thus of said arm can take place only by causing said pull rod to slide in one direction or the other along the generator line of its support, one of the ends of said pull rod further being extended by an upside-down U-shaped yoke designed to be engaged astride a complementary collar without rubbing thereagainst, which collar forms a portion of a fixed frame and is coaxial with the drum, such that co-operation between said collar and the yoke secured to the pull rod it normally impossible for said pull rod to slide, thereby preventing any unlocking of the printwheels, an opening being provided in said collar and being positioned so that the yoke comes astride said opening when the drum is in its rest position in which adjustment of the printwheels is authorized, such that in said position and only in said position, the yoke and the collar do not prevent the pull rod from sliding, thus leaving the printwheels free to be unlocked, and consequently to be adjusted.

According to another characteristic of the invention, said unlocking finger is a centering finger of another member of the postage meter and is provided to co-operate with a guide opening appropriately formed in the body of the print drum.

BRIEF DESCRIPTION OF THE DRAWING

In any event, the invention will be well understood and its advantages and other characteristics will appear on reading the following description of a non-limiting embodiment, the description being given with reference to the accompanying diagrammatic drawing in which the sole figure is a perspective view of the locking device, the print drum being shown in its rest position.

DESCRIPTION OF THE PREFERRED EMBODIMENT

With reference to the sole figure, there can be seen a rotary print drum 1 that is fitted in conventional manner to the print head of a postage meter. In this simplified example, the drum 1 is assumed to carry six mutually coaxial printwheels 2. So long as these printwheels are not locked, it is possible to change their settings, i.e. to change the digits or letters that they print, merely by rotating said printwheels individually about their common axis 3.

In theory, such rotation could be performed manually assuming that the printwheels were directly accessible to a user, as shown in the figure. However, in practice this is not the case since postal authorities require free access to be prohibited, and as a result each printwheel 2 is secured to a coaxial toothed wheel 4 which, so long as it is unlocked in the manner described below, is capable of being rotated by a driving system that is itself under the control of the keypad of the postage meter.

In any event, the essential point is that the printwheels 2 should be locked in position throughout rotation of the print drum, so as to prevent the printwheel setting being modified, whether accidentally or otherwise, throughout the operation of printing the postage amount represented by the printwheels. Naturally, it is also necessary for it to be possible to unlock the printwheels when the drum is in its rest position and for it to be possible to unlock them only in said rest position.

In addition the locking must be positive, i.e. it must be certain. That would not be the case, for example, if locking depended solely on a return spring that might be broken accidentally while the print drum was rotating. The device of the invention as described below and as fitted to the drum, makes it possible to satisfy these requirements.

Basically, the locking device comprises a locking bail 5 mounted to tilt about a shaft 6 fixed to the drum 1 and extending parallel to the axis 3 of the printwheels 2.

The tilting bail 5 carries as many locking teeth 7 as there are printwheels 2, i.e. five teeth 7 in the simplified example shown. The teeth 7 are shaped and disposed so as to engage in respective ones of the toothed wheels 4 associated with the various printwheels 2, thereby locking each of the printwheels in position whenever the bail 5 is tilted forwards under drive from a powerful return spring 8 extended between a stud 9 secured to the drum 1 and another stud 10 secured to an arm 11 of the bail 5, the stud 10 being located on said arm 11 beneath the shaft 6 such that the action of the spring 8 does indeed tend to tilt the bail 5 forwards, thereby engaging its locking teeth 7 in the toothed wheel 4.

In order to tilt the bail 5 backwards, against the force of the return spring 8, and thus unlock the printwheels 2, a crank lever 12 is provided mounted to rock about an axis 13 orthogonal to the tilt axis 6 of the bail 5.

A first free end 14 of the crank lever 12 bears against an abutment 15 secured to the bail 5.

The other free end 16 of the lever 12 includes a lateral swelling 17 designed to co-operate with an external control finger 18 having a conical tip 19. The finger passes through a guide orifice 20 formed in the body of the print drum 1.

As represented by dashed lines in the figure, when the finger 18 is advanced in the direction of arrow 21 towards the lever 12, it pushes against the side of the swelling 17, thereby rocking the lever 12 as shown by arrow 23 in a clockwise direction, thereby causing it to press against the abutment 15 so as to tilt the bail 5 backwards against the force of the spring 8, thus unlocking the printwheels 2.

As now explained, it should be observed that such backwards tilting of the bail 5, with attendant unlocking of the printwheels, is made possible in accordance with the invention only when the drum 1 is in its rest position as shown in the figure, in which position there is nothing to prevent the arm 11 from tilting.

As shown, the free end 24 of the arm 11 is permanently engaged in a notch 25 of a locking security pull rod 26 slidably mounted in a slideway 27 secured to the drum 1 and extending along one of the generator lines of the drum 1.

As a result, the arm 11 can be tilted as shown in dashed lines only by causing the pull rod 26 to be slid along said generator line of the drum that is coaxial therewith and as shown by the arrows.

The free end 29 of the pull rod 26 opposite from its end 28 that is adjacent to the notch 25 and that forms a retaining abutment for the pull rod, is extended by a yoke 30 constituting an upside-down U-shape.

The yoke 30 is designed to fit astride a complementary collar 31 without rubbing thereagainst, which collar forms a portion of the frame 22 that supports the drum 1 and is coaxial therewith.

A notch or opening 32 is provided in the collar 31 and is positioned therein so that the yoke 30 lies astride said opening when the drum 1 is in its rest position. Under such circumstances, there is nothing to prevent the security pull rod 26 sliding along its slideway 27 so as to enable the printwheels to be unlocked, thus making it possible to adjust their positions.

In contrast, when the drum rotates for the purpose of printing an envelope to be franked, and as shown in dashed lines in the figure, the yoke 30 is positively engaged astride the fixed collar 31. The arm 11 is then securely locked in a position that corresponds to the printwheels 2 being locked by the bail 5 since there is no way the pull rod 26 can slide along its longitudinal axis. The printwheels 2 are thus positively locked since locking is maintained even in the event of the return spring 8 failing.

It should be observed that the finger 18 for performing unlocking may be provided solely for that purpose, but it is preferable for it to be positively incorporated in the postage meter in which it simultaneously performs the role of a guide finger: this applies, for example, when the machine includes a removable head containing the print drum and designed to couple with a fixed base that includes, in particular, the controlling keypad. The finger 18 then also serves, in co-operation with the guide opening 20 in the tab 1A, as a finger for establishing relative centering between the head and the base. For example, it may serve as a guide finger for a set of driving gear wheels with associated motors that are positioned in a tilting module included in the base, said module being tilted towards the head solely for the purpose of setting the printwheels, in which case it is guided by co-operation between the finger 18 and the guide opening 20 in the tab 1A on the drum.

Naturally, the invention is not limited by the embodiment described above. On the contrary, it may be implemented in numerous equivalent forms.

We claim:

1. A device for locking adjustable printwheels, which are carried in alignment on a common axis by a rotary drum fitted in a postage meter, comprising:

a prim drum having a generator line;

a fixed frame including a collar, said collar being coaxial with said prim drum;

a plurality of printwheels having an axis of rotation and mounted in said print drum;

a coaxial toothed wheel secured to each of said plurality of printwheels;

a shaft mounted on said print drum on an axis parallel to said axis of rotation of said plurality of printwheels;

a bail tiltably mounted on said shaft, said bail including at least as many locking teeth as said plurality of printwheels, said bail further including an abutment and an arm;

at least one return spring fixed to said print drum for urging said bail towards a printwheel-locking position, each of said plurality of teeth engaging a respective one of said toothed wheels when said bail is in the printwheel-locking position;

a crank lever pivotally mounted on an axis orthogonal to the axis of said shaft and having a first free end and a second free end, said first free end engaging said abutment of said bail to cause said bail to be tilted against the force of said return spring into a position in which it unlocks said plurality of printwheels;

an unlocking control member located external to said print drum and engaging said second free end of said crank lever to pivot said crank lever and thus unlock said plurality of printwheels; and a locking security pull rod slidably mounted on said generator line; said pull rod including a notch and an upside-down U-shaped yoke at an end thereof, said arm of said bail being permanently engaged in said notch, said upside-down U-shaped yoke straddling said collar of said fixed frame without rubbing thereagainst; said yoke preventing said pull rod from sliding and consequently preventing said bail from unlocking of said printwheels;

said collar including an opening for enabling said pull rod to slide and said bail to unlock said printwheels when said opening is aligned with said yoke.

2. A locking device according to claim 1, wherein said print drum includes a guide opening formed therein, and wherein said unlocking control member comprises a centering finger for cooperating with said guide opening.

* * * * *